United States Patent [19]

Yoshida

[11] 3,939,543

[45] Feb. 24, 1976

[54] SLIDER HOLDER FOR ATTACHING A SLIDER TO A FASTENER CHAIN SECURED TO AN ARTICLE

[75] Inventor: Hiroshi Yoshida, Uozu, Japan

[73] Assignee: Yoshida Kogyo Kabushiki Kaisha, Japan

[22] Filed: Oct. 9, 1974

[21] Appl. No.: 513,266

Related U.S. Application Data

[62] Division of Ser. No. 387,192, Aug. 9, 1973.

[30] Foreign Application Priority Data

Aug. 12, 1972 Japan ..... 47-80897

[52] U.S. Cl. ..... 29/207.5 SL; 29/207.5 R

[51] Int. Cl.[2] ..... B21D 53/50; B29D 5/00

[58] Field of Search 29/207.5 SL, 207.5 R, 207.5 ST, 29/408, 409, 33.2

[56] References Cited

UNITED STATES PATENTS

| | | | |
|---|---|---|---|
| 3,792,521 | 2/1974 | Kawakami | 29/207.5 SL X |
| 3,844,014 | 10/1974 | Takahashi | 29/207.5 SL |
| 3,844,015 | 10/1974 | Kawakami | 29/207.5 SL |

*Primary Examiner*—Victor A. Di Palma
*Attorney, Agent, or Firm*—Robert E. Burns; Emmanuel J. Lobato; Bruce L. Adams

[57] ABSTRACT

A slider holder including a support structure having a slider mount on a top portion thereof. The slider mount has a top surface inclined to the plane of the horizon for receiving and positioning a slider upside down with the bottom end of the slider directed downwardly and with the guide channels of the slider inclined to the plane of the horizon. A lever having a detent is turnably supported to engage and disengage an opening of the slider pull tab and releasably lock the slider in the slider mount. In use, a pair of stringers mounted on an article and having elastically deformable fastener elements are successively pulled through the slider guide channels in a downward direction and positioned so that the fastener elements are aligned. The stringers are then simultaneously pulled upwardly through the guide channels to engage the fastener elements, and the slider is then released from the holder.

2 Claims, 9 Drawing Figures

SLIDER HOLDER FOR ATTACHING A SLIDER TO A FASTENER CHAIN SECURED TO AN ARTICLE

This is a division, of application Ser. No. 387,192, filed Aug. 9, 1973.

BACKGROUND OF THE INVENTION

This invention relates generally to slide fasteners, and in particular to a method of attaching a slider to a fastener chain after the same is secured to the edges of an opening in a garment or like article. The invention is also specifically directed to a slider holder adapted for use with such method.

It is now widely practised among the manufacturers of ready-made garments and other articles to cut an elongate slide fastener chain (by which are meant a pair of tapes carrying longitudinal rows of fastener elements along the opposed inside edges thereof) into lengths determined in accordance with the shape and size of the articles and to sew or otherwise secure such required lengths of the fastener chain to the successive articles. Other parts of the slide fasteners, such as top and bottom stops as well as sliders, are attached after the fastener chain is secured to the articles. It has been found that this practice results in a great saving in the manufacturing costs of such articles.

However, this practice has its own disadvantage with regard to the manipulation of the fastener stringers, which have been secured to the edges of a desired article as aforesaid, through the guide channels in the slider so as to cause the rows of fastener elements on their opposed inside edges to interlock properly in their correct relative positions. It requires the highest degree of dexterity and mental concentration on the part of the workers to manually thread the two fastener stringers simultaneously through the slider without causing misalignment between the interfitting rows of fastener elements. For this reason the assembly operation of the slide fasteners according to the above described practice has been highly retarded.

In order to overcome the foregoing disadvantage of the prior art, some manufacturers have more recently resorted to the use of fastener elements capable of elastic deformation. Such fastener elements are formed of synthetic resin monofilaments, such as those of polyamide or polyester, and are either coiled or zigzagged in shape. In the use of these known fastener elements, the fastener stringers secured to an article are manipulated through the guide channels in the slider one after the other. The resultantly interlocked rows of fastener elements in wrong relative positions are then manually separated from each other so that the fastener elements are still held interlocked only at their portions within the slider which is now located at one extremity of the fastener stringers.

Thereafter, in order to readjust the relative positions of the misfitting fastener elements, one of the stringers is forcibly pulled through the slider by taking advantage of the elastic deformation of the fastener elements. Following this operation it is necessary that the two fastener stringers be pulled in a fastener closing direction through the slider so that the latter will be positioned at or adjacent that point on the stringers where a bottom stop is to be affixed. This bottom stop is secured to the required point after pulling the fastener stringers back again through the slider in a fastener closing direction. This latter method is currently preferred because it facilitates the assembly operation of the slide fasteners, without requiring undue attention to the correct alignment of the fastener elements.

A special problem has arisen in connection with the second described method, however, in that the fastener elements are frequently caught in the guide channels in the slider as the fastener stringers are pulled therethrough in a fastener opening direction following the readjustment of the relative positions of the misfitting fastener elements. If only this problem is overcome, it is certain that the assembly operation of the slide fasteners according to this second method will be still more expedited.

As a result of extensive search for the possible causes of the above noted problem, it has now been discovered that since the slider is held horizontally during the assembly operation in accordance with the prior art, the fastener elements on the inside edges of the stringers stand up, so to say, as the stringers are caused to make a sharp turn from their vertical to horizontal position to be fed into the guide channels in the slider. Moreover, because the fastener stringers are already secured to an article as above stated, they are inevitably held vertically due to the added weight of the article. This is all the more reason why the free ends of the fastener elements rise and get caught in the slider guide channels.

SUMMARY OF THE INVENTION

In view of the noted difficulties of the prior art, it is an object of this invention to provide an improved method of attaching a slider to a pair of fastener stringers secured to an article, wherein the slider is held in such a manner that there is practically no possibility of fastener elements on the opposed inside edges of the fastener stringers being caught in the guide channels in the slider as the stringers are pulled therethrough, whereby the rate of finishing the fastener chain on the articles is increased manifold.

It is also an object of this invention to provide a slider holder having a slider mount adapted to hold the slider in the manner conducive to the first recited object of the invention.

According to the method of this invention, briefly stated with regard to one aspect thereof, a slider is first placed upside down on a slider mount which is disposed at an angle to the plane of the horizon, with the bottom end of the slider directed downwardly. A pair of fastener stringers secured to an article are then threaded one after the other through the respective guide channels in the slider, and the fastener stringers are forcibly pulled downwardly through the slider to readjust the relative positions of the misfitting fastener elements by taking advantage of their elastic deformation. Thereafter the fastener stringers are pulled back upwardly through the slider in a fastener opening direction. In this instance, thanks to the angle at which the slider is held with respect to the plane of the horizon, the fastener stringers with the attached elements are permitted to pass smoothly therethrough.

The features which are believed to be novel and characteristic of this invention are set forth with particularity in the appended claims. The invention itself, however, together with the further objects and advantages thereof, will be best understood from the following description of specific embodiments taken in conjunction with the accompanying drawings wherein like reference numerals denote like parts throughout the several views.

DESCRIPTION OF THE PREFERRED EMBODIMENTS

Figure 1:
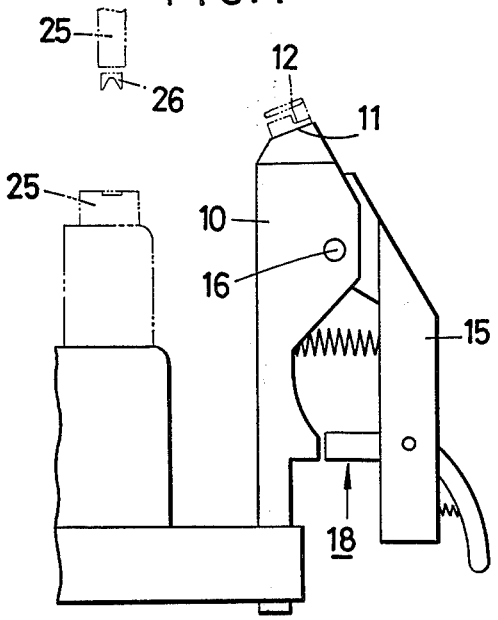
FIG. 1 is a side elevational view of an example of slider holder adapted for use with the method of this invention, the view also showing dies for securing a bottom stop to a pair of fastener stringers after attachment of a slider thereto.
Figure 2:
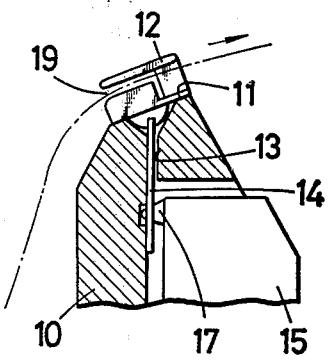
FIG. 2 is a fragmentary vertical sectional view on enlarged scale of the slider holder shown in FIG. 1.

With reference to FIGS. 1 and 2 which illustrate an example of slider holder suitable for use with the method of this invention, the exemplified slider holder includes a support structure 10 having a slider mount 11 on its top. The slider mount 11 is recessed as best shown in FIG. 2 to securely support a slider 12 placed upside down thereon, and a channel 13 extends vertically downwardly from the recessed slider mount through the support structure 10 to telescopically receive a pull tab 14 of the slider.

A lever 15 turnably supported at 16 on one side of the support structure 10 has a detent 17 adapted to project into the usual opening formed in the slider pull tab 14 and hence to lock the slider in position on the slider mount 11. Preferably, the lever 15 is provided with suitable stop means, such as that indicated at 18 in FIG. 1, for normally holding the same immovable in the illustrated position to prevent any accidental unlocking of the slider 12 during assemblage of a fastener chain therethrough.

According to this invention, the general surface of the slider mount 11 on the top of the support structure 10 is formed at an angle to the plane of the horizon as in the drawings, for purposes which will be made more apparent from the following description of the method of the invention.

The slider 12 is first placed upside down on the sloping slider mount 11, with its bottom end 19 (defining an outlet opening opposite to the neck of the slider) directed downwardly as best shown in FIG. 2, and is locked in position by the detent 17 projecting into the opening of its pull tab 14. Thereafter, a fastener chain or a pair of fastener stringers 20 and 21 already secured to parts of a garment or like article 22 are assembled through the slider 12. In the sequence illustrated in FIGS. 3A to 3E.

Figure 3A:
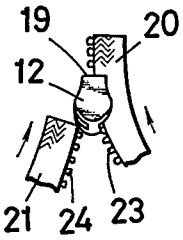
FIGS. 3A to 3E inclusive are fragmentary top views sequentially illustrating the steps of attaching a slider to a pair of fastener stringers in accordance with the method of the invention.
Figure 3B:
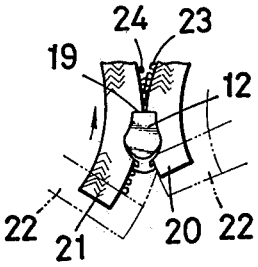

As seen in FIG. 3A, one of the fastener stringers, 20 for example, is first threaded through the corresponding guide channel in the slider 12, and then the other fastener stringer 21 is likewise threaded through the other guide channel, as indicated by the arrows in the drawing. The resultantly mismatched fastener elements 23 and 24 on the beaded inside edges of the fastener stringers 20 and 21 are then separated from each other all the way up to the bottom end 19 of the slider, as shown in FIG. 3B, so that the elements 23 and 24 are now interlocked only at their portions within the slider.

Figure 3C:
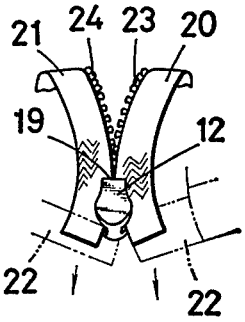

The fastener stringer 21 which has been threaded later through the slider 12 is then forcibly pulled downwardly therethrough by taking advantage of the elastic deformation of the elements interfitting within the slider, until the upper extremities of the fastener stringers 20 and 21 are aligned as shown in FIG. 3C. The fastener elements 23 and 24 on both fastener stringers are now properly interlocked within the slider.

Figure 3D:
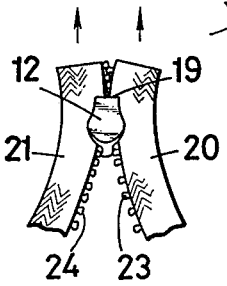

Thereafter the fastener stringers 20 and 21 together with the article 22 to which they are attached are pulled upwardly, that is, in a fastener opening direction, through the slider 12, so that as seen in FIG. 3D the slider is located at or adjacent that point on the fastener stringers where a bottom stop is to be affixed. The fastener stringers are now substantially fully opened.

Figure 3E:
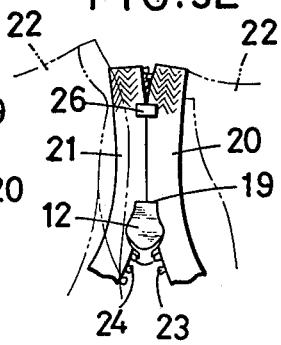

Then, as illustrated in FIG. 3E, the fastener stringers 20 and 21 are again pulled back through the slider 12 in a fastener closing direction so that the lower end portions of the closed stringer are placed in position on the lower one of dies 25, FIG. 1, adapted to affix the bottom stop 26 thereto. The lever 15 of the slider holder shown in FIGS. 1 and 2 is then turned after releasing the stop means 18, and the article 22 with the fastener stringers and the slider and bottom stop attached thereto is withdrawn from the slider holder.

Figure 4:
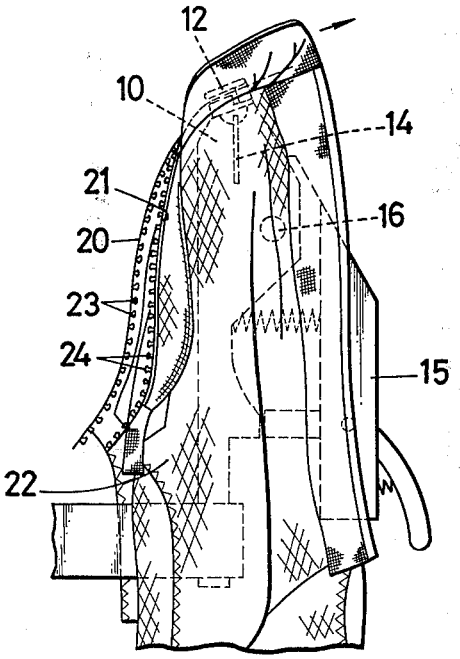
FIG. 4 is a side view explanatory of the mode of use of the slider holder according to the invention.
Figure 5:
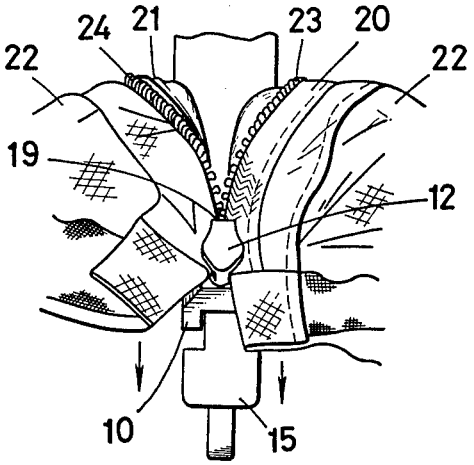
FIG. 5 is a top view also explanatory of the mode of use of the slider holder according to the invention.

In the above described method of this invention, it is particularly noteworthy that, after the fastener stringers 20 and 21 have been coupled properly together as shown in FIG. 3C, the stringers 20 and 21 are pulled upwardly in a fastener opening direction through the slider 12 which is supported on the sloping slider mount 11 of the slider holder with its bottom end 19 directed downwardly. Thus, as illustrated in FIG. 4, the fastener stringers are draped down in a substantially streamlined manner with increased radius of curvature of the fastener chain with respect to the bottom end 19 of the slider which is itself supported at a suitable angle to the plane of the horizon. As a consequence, the rows of fastener elements 23 and 24 on the inside edges of these fastener stringers can be held completely aligned with each other in the plane of the fastener stringers and smoothed meshed together as they are introduced into the slider, as will be seen from FIG. 5. It will accordingly be understood that the fastener stringers carrying the elements thus held aligned can be pulled smoothly through the slider.

It is believed that the improvements and advantages gained by the method and device of this invention will be apparent from the foregoing description. However, it is to be clearly understood that the preferred forms of the invention as herein desclosed are subject to various modifications or changes without departing from the scope of the invention, as sought to be defined by the following claims.

What is claimed is:

1. A slider holder for use in attaching a slider having a pair of guide channels to a pair of fastener stringers which are already secured to an article, wherein the fastener stringers are provided along a pair of opposed inside edges thereof with rows of fastener elements capable of elastic deformation, said slider holder comprising: a support structure having a slider mount on a top portion thereof, said slider mount having a top surface which is inclined at an angle to the plane of the horizon for receiving and positioning the slider upside down with the bottom end thereof directed downwardly; and means for locking the slider in position on said slider mount, whereby the fastener stringers may be threaded through the guide channels in the slider and forcibly pulled downwardly therethrough to adjust the relative positions of mismatched fastener elements by elastic deformation thereof, and then the stringers may be smoothly pulled back upwardly through the slider to engage the fastener elements.

2. A slider holder according to claim 1, wherein said slider mount includes means defining a channel extending downwardly from said top surface for receiving a slider pull tab, and wherein said means for locking the slider comprises a lever having a detent, means turnably mounting said lever on said support structure for rendering said lever turnable from a first position with said detent engaging an opening in the slider pull tab to a second position disengaged from the slider pull tab, and means for releasably locking said lever in said first position.

* * * * *